166-66

10/10/78 XR 4,119,148 SR

United States Patent [19]

Deardorf

[11] 4,119,148

[45] Oct. 10, 1978

[54] PERFORATING APPARATUS AND METHOD FOR WELL CASING

[76] Inventor: Eldon N. Deardorf, 1611 Red Fox Dr., Dayton, Ohio 45432

[21] Appl. No.: 831,229

[22] Filed: Sep. 7, 1977

[51] Int. Cl.[2] ..... E21B 43/11; E21B 47/12

[52] U.S. Cl. ..... 166/250; 166/55.2; 166/66; 166/298

[58] Field of Search ..... 175/4.52, 77; 166/55, 166/55.1, 55.2, 55.7, 100, 253, 297, 66, 298, 250

[56] References Cited

U.S. PATENT DOCUMENTS

| | | | |
|---|---|---|---|
| 2,188,409 | 1/1940 | Lane | 166/55.7 |
| 2,599,405 | 6/1952 | Mennecier | 175/40 |
| 2,674,313 | 4/1954 | Chambers | 166/100 |
| 2,965,031 | 12/1960 | Johns | 166/55 |
| 3,309,656 | 3/1967 | Godbey | 324/1 |
| 3,397,356 | 8/1968 | Dumanoir | 324/1 |
| 3,469,639 | 9/1969 | Charlade | 175/78 |
| 3,528,515 | 9/1970 | Garrison | 175/78 |
| 3,653,436 | 4/1972 | Anderson et al. | 166/100 |

*Primary Examiner*—Stephen J. Novosad

[57] ABSTRACT

An apparatus and method for perforating a well casing. The apparatus includes a drilling mechanism comprising an air-operated drill mounted between forward and rear frame members, a drill bit connected to the air drill and extending from the forward frame member, an inflatable bladder mounted on the back of the rear frame member, and plural coil springs mounted along the front of the forward frame member. The air drill and bladder are connected to an air compressor which drives the air drill and also inflates the bladder to push the drill bit into the portion of the well casing to be perforated and at the same time causes the coil springs to compress between the forward frame member and the well casing. When the drilling of each perforation is completed, a vacuum source evacuates the air from within the bladder, and the coil springs then push the forward frame member away from the well casing so that the drill bit is withdrawn from the perforation. A microswitch is mounted on the forward frame member and has a press button which is engaged by the well casing when each perforation is completed and which energizes a lamp to alert the operator. A microphone is mounted on the frame members so that the operator may monitor the activity to determine if fluid drains through the perforation or perforations completed.

8 Claims, 3 Drawing Figures

10
12
14
16
18
20
22
24
28
30
32
38
40
42
44
46
47
48
50
52
66
68
70
72
73
74
76
78
80
82
84
86
88
90
92
94
96
98
100
102
104

PERFORATING APPARATUS AND METHOD FOR WELL CASING

BACKGROUND OF THE INVENTION

1. Field of the Invention

The present invention relates to an apparatus and method for performing a drilling operation within the interior of a well or the like and, in particular, to such an apparatus and method wherein means are provided for advancing a drill bit or tool to engage the wall or casing of the well and to withdraw the tool after completion of the drilling operation.

2. Description of the Prior Art

It is not uncommon during the life of a water, oil or gas well for the perforations in the well casing through which fluid passes to become clogged or, in the case of a water well, for the water table to drop significantly, such that new perforations must be made or the old perforations relocated.

In the past, this has been accomplished in any of several ways. In the case where the water table has dropped, one such way is to use an apparatus which drives or pounds the well casing deeper into the earth so that the perforations are again below the water table. However, the driving of the casing requires the use of expensive and large equipment and will sometimes cause the well casing to collapse.

If new perforations are desired, a scissor-type tool may be lowered into the casing which will slit the sides of the casing to create new openings. It is also know to use a gun-type perforator which is lowered into the casing and which shoots projectiles into the casing to create perforations. These types of operations will frequently weaken or seriously damage the well casing.

It has also been proposed to lower a drilling mechanism into a well casing to drill new perforations. An example of such a drilling mechanism is shown in U.S. Pat. No. 3,528,515, entitled "Rotary Perforating Tool and System for Well Perforation," issued to M. A. Garrison. The problem with a drilling mechanism is that there is required a device for remotely advancing and withdrawing the drill member or bit, and this often makes the drilling mechanism expensive, because of the numerous mechanical components involved, and difficult to support within the well casing during operation. In addition, failure of the mechanical components of the mechanism before withdrawal of the drill bit from the perforation can result in the drill bit being lodged in the casing and can require that the mechanism be dismantled piece by piece within the casing, or even that it be abandoned within the casing and a new well dug.

SUMMARY OF THE INVENTION

An apparatus in accordance with the present invention includes a drilling mechanism having means, such as an inflatable bladder mounted on generally one side of the mechanism, for pressing a drill bit or tool on a generally opposite side of the drilling mechanism against the portion of the well casing which is to be perforated. Spring means are located on the drilling mechanism for engaging the casing when the drill bit is pressed to the casing and for biasing the drilling mechanism away from the casing so that when the drilling of each perforation is completed and the bladder deflated, the spring means push the drilling mechanism away from the casing and assure complete withdrawal of the drill bit from the perforation. The use of springs to push the drilling mechanism away from the casing reduces the likelihood of mechanical failure during the withdrawal of the drill bit and the possibility that the bit might be irretrievably lodged in the casing.

The use of a bladder to advance the drill bit and the use of springs to withdraw it enables the apparatus to be simple in design, lightweight and inexpensive to manufacture. In the disclosed apparatus, the drilling mechanism includes an air-operated drill mounted on a frame. The frame may be lowered into the well casing without the need of an extensive supporting structure or a derrick. An air compressor above ground can both inflate the bladder and operate the drill, and the entire perforating operation can easily be accomplished by one or two workmen.

Description of the Preferred Embodiment

Figure 1:
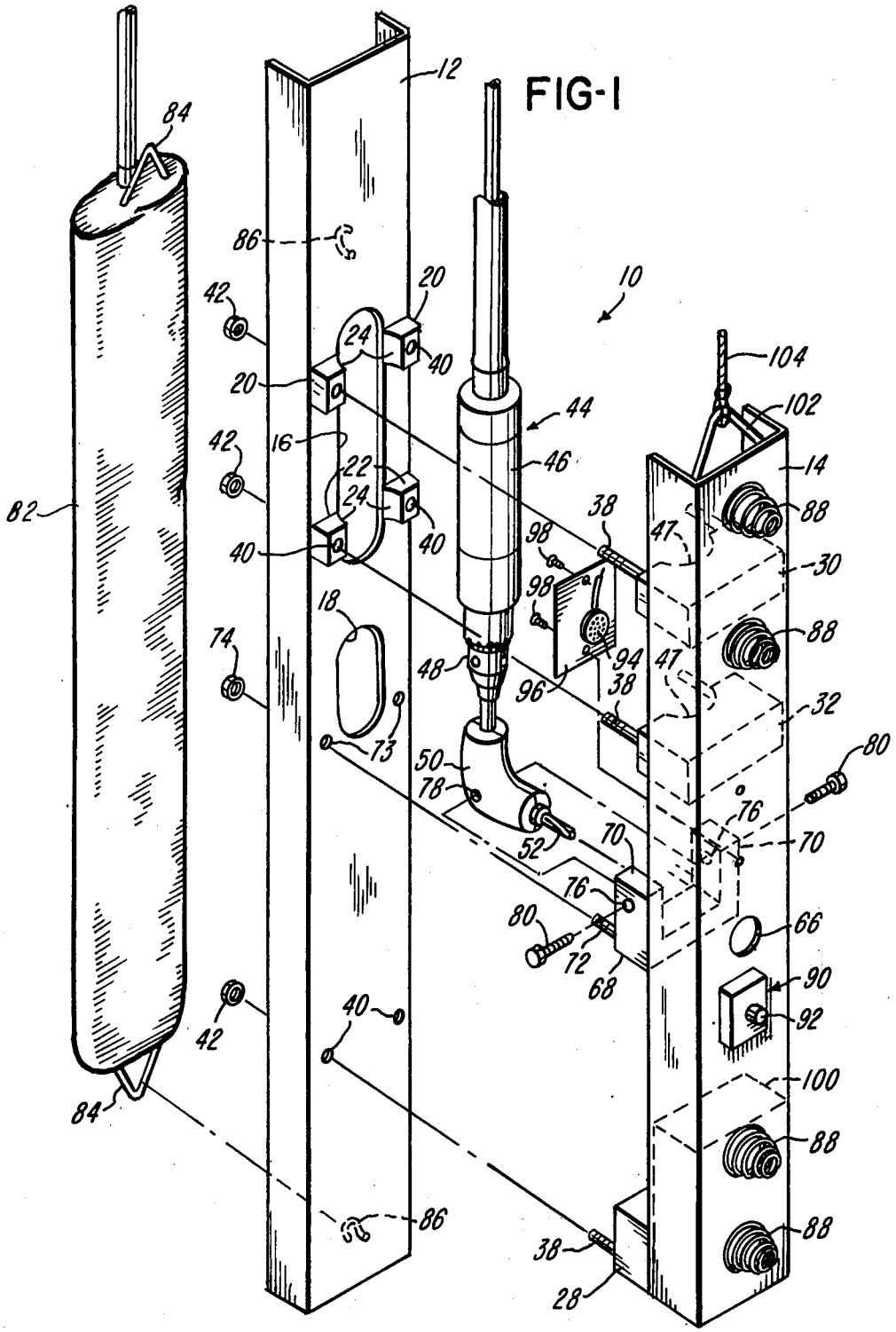
FIG. 1 is an exploded perspective view of the drilling mechanism of an apparatus in accordance with the present invention.

Referring to FIG. 1, a drilling mechanism 10 of an apparatus in accordance with the present invention includes a frame comprising a rear frame member 12 and a shorter, forward frame member 14. The frame members 12 and 14 may be channel-shaped as illustrated. The rear frame member 12 has an upper cutaway portion 16, a lower cutaway portion 18 and, formed adjacent the cutaway portion 16, a pair of upper spacing members or bosses 20 and a pair of lower spacing members or bosses 22. For reasons which will become apparent, the bosses 20 amd 22 each have a curved side 24 adjacent the cutaway portion 16.

When assembled, forward frame member 14 and rear frame member 12 are held in spaced relation by means of a spacing block 28 and by means of yoke bars 30 and 32 which mate with the pairs of bosses 20 and 22, respectively. The yoke bars 30 and 32 and the spacing block 28 are secured to the frame member 14, such as by welding, and have threaded studs 38 projecting therefrom which pass through aligned apertures 40 in the rear frame member 12 and which receive nuts 42 for securing the frame members 12 and 14 together.

A conventional air-operated drill 44 is located between the rear and forward frame members 12 and 14 and has a cylindrical housing 46 which is trapped between the pairs of bosses 20 and 22 and the upper and lower yoke bars 30 and 32 when the rear and forward frame members 12 and 14 are assembled as described above. The yoke bars 30 and 32 each have a semicircular notch 47 which cooperates with the curved sides 24 of the bosses 20 and 22 to clamp the cylindrical housing 46 of the air drill 44 and hold it firmly between the frame members 12 and 14.

The air drill 44 has a chuck mechanism 48 which drivingly connects the output of the drill 44 to the input of a conventional right angle drive 50. A drill bit 52 is connected to and rotatably driven by the output of the right angle drive 50. When the frame members 12 and 14 are assembled, the drill bit 52 extends through a hole 66 on the front frame member 14, and the cutaway portions 16 and 18 on the rear frame member 12 provide clearance for the cylindrical housing 46 of the air drill 44 and the housing of the right angle drive 50, respectively.

The right angle drive 50 is mounted on the rear frame member 12 by a generally U-shaped support bracket 68 having two upstanding legs 70. The U-shaped support bracket 68 has threaded studs 72, only one of which is shown, which pass through apertures 73 in the frame member 12 and which receive nuts 74. The bracket 68 includes apertures 76, one in each of its upstanding legs 70, which align with threaded apertures 78 in the body of the right angle drive 50 when the frame members 12 and 14 are assembled. Threaded bolts 80 pass through the aligned apertures 76 and 78 and secure the right angle drive to the U-shaped bracket 68, which in turn secures the right angle drive to the rear frame member 12.

An inflatable bladder 82 made from plastic, rubber or the like is mounted on the backside of frame member 12 by means of loops 84 which may be integral with or attached, such as by sewing, to the bladder 82. The loops 84 are fastened to hooks 86 and mounted on the backside of frame member 12.

Four coil springs 88 are mounted on the front of the frame member 14 along with a microswitch 90 that includes a press button 92. Also, a conventional waterproof microphone 94 is held in place on the backside of the forward frame member 14 by means of a rubber patch or plate 96 which is secured to the frame member 14 by screws 98. As shown in phantom detail in FIG. 1, the lower end of the frame member 14 may include a heavy metal block or weight 100 so that the drilling mechanism 10 will not tend to float if water is in the well. At the top of the frame member 14 is a handle 102 to which a rope or cord 104 may be attached for lowering the apparatus into a well casing.

When the drilling mechanism 10 is assembled as described above, the bladder 82 is located generally on one side of the drilling mechanism, and the drill bit 52 and the coil springs 88 are located on a generally opposite side of the drilling mechanism. Accordingly, when the bladder 82 is inflated within a well casing and expands in a direction against one side or portion of the casing, the drill bit 52 will be advanced in an opposite direction toward the portion of the casing to be perforated.

Figure 2:
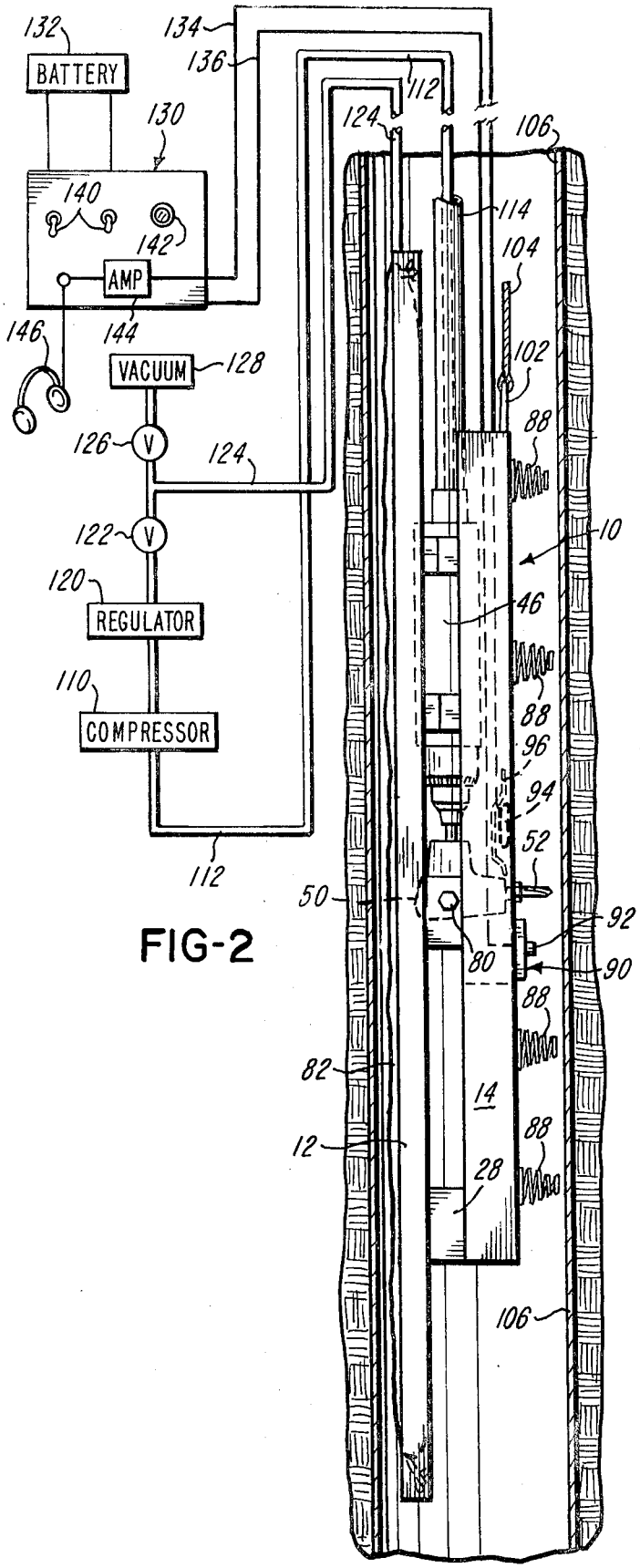
FIG. 2 is an elevational view with portions broken away, illustrating the drilling mechanism after lowered into a well casing.
Figure 3:
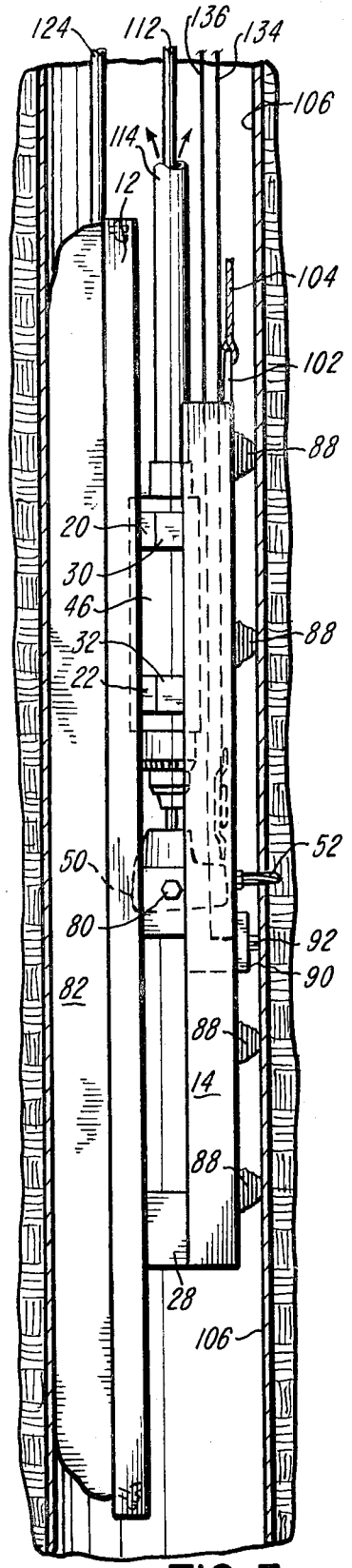
FIG. 3 is similar to FIG. 2, showing the drilling mechanism in the well casing shortly after the completion of a perforation and before drill bit withdrawal.

FIGS. 2 and 3 illustrate the apparatus after the drilling mechanism 10 has been lowered into a well casing, designated 106. The well casing 106 may be typical of those used in residential water wells, having a diameter of approximately six inches (15.24 cm) and a casing thickness of approximately ⅛ inch (0.32 cm). Referring to the drilling mechanism 10, the distance from the rear, i.e., the left-hand side as viewed in FIG. 2, of frame member 12 to the free end of each spring 88 will be approximately 5 inches (12.70 cm). Since, as illustrated in FIG. 2, the bladder 82 when deflated will be located almost entirely within the channel of the rear frame member 12 and does not add substantially to the size of the drilling mechanism 10, the drilling mechanism 10 can be freely lowered into the well casing 106.

For reasons which will become apparent, the springs 88 project at least slightly farther from the front of frame member 14 than the drill bit 52. In addition, the drill bit 52 projects at least slightly more than ⅛ inch (0.32 cm) farther from the front of frame member 14 than the press button 92 of the microswitch 90.

As seen only in FIG. 2, a conventional air compressor 110 provides compressed air by way of a plastic or rubber inner air hose 112 to the air drill 44. An outer hose or sheath 114 connected to the air drill 44 surrounds the air hose 112 for at least a portion of its length and is sufficiently large at its inner diameter to provide a clearance between the hoses 112 and 114 so that air exhausted from the air drill 44 may freely pass between the air hoses 112 and 114 upwardly and away from the drilling mechanism 10. Resistance to the exhaust which might otherwise be caused by the water within the well and around the drill 44 and which would reduce the power delivered by the drill is thereby minimized.

It has been found that the pressure of the air delivered by the compressor 110 to adequately operate the drill 44 for most perforating operations can be approximately 100 pounds per square inch (psi). However, the compressor 110 also delivers air to the bladder 82, which must normally be inflated by a lower air pressure, for example, 30 psi, to prevent excessive inflation and bursting of the bladder. Accordingly, the compressor 110 provides compressed or pressurized air to the bladder 82 by way of a regulator 120, which reduces the pressure of the air, and a needle valve 122, which permits adjustment of the actual pressure of the air delivered to the bladder 82. A hose 124 connects the needle valve 122 to the bladder 82. The hose 124 is also connected by a needle valve 126 to an air vacuum source 128. The vacuum source 128 may be any conventional air suction device. As will be described more fully later, the vacuum source 128 and needle valve 126 serve to evacuate the air from the hose 124 and the bladder 82 to provide rapid deflation of the bladder 82 and consequent withdrawal of the drill bit 52 from each perforation made in the casing 106.

Also illustrated in FIG. 2 is a control panel 130 which is powered by a conventional electrical power source, such as a battery 132. The control panel is connected to the microphone 94 by a conductor 134 and to the microswitch 90 by a conductor 136. The control panel may include on-off switches 140 and an indicating lamp 142 which is controlled by the microswitch 90. The control panel further includes a conventional audio amplifier 144 and earphones 146 for receiving signals from the microphone 94 transmitted by way of the conductor 134 and amplifier 144.

The compressor 110, regulator 120, valves 122 and 126, vacuum source 128, control panel 130 and battery 132 are all normally located on or above the ground near the well, such as on a small truck or other vehicle, during normal operation of the drilling mechanism 10. After the drilling mechanism 10 has been lowered to a depth where a perforation is to be made, the operator actuates the compressor so that the drill 44 operates, and opens the needle valve 122 to begin the inflation of the bladder 82. As seen in FIG. 3, as the inflated bladder 82 pushes against the portion of well casing 106 adjacent the rear frame member 12, the springs 88 and drill bit 52 will be advanced in a generally opposite direction and the springs 88 will be brought into contact with the well casing. With continued inflation of the bladder 82, the springs 88 will compress and drill bit 52 will come into contact with and commence perforation of that portion of the well casing 106 confronted by the drill bit 52. The needle valve 122 may be adjusted as needed to increase the air pressure within the bladder 82 and thereby increase the pressure exerted by the drill bit 52 on the well casing as the drilling operation progresses.

After the drilling has progressed far enough that the drill bit 52 pierces the well casing, the resulting movement of the drilling mechanism 10 toward the perforated side of the well casing will result in the press button 92 of the microswitch 90 contacting and being depressed by the well casing, as illustrated in FIG. 3. The lamp 142 on the control panel 130 is thus energized to alert the operator at the ground surface above the well that the perforation has been completed. The operator will then close valve 122 and open valve 126 and energize the vacuum source 128 so that the air is evacuated from within the bladder 82. The compressed springs 88 will then expand and force the drilling mechanism away from the perforated side of the well casing so as to withdraw the drill bit 52 from the perforation.

With at least the initial perforation, the operator may monitor or listen to, by means of microphone 94, amplifier 144 and earphones 146, the casing at the perforation to determine whether water spurts or drains from the completed perforation into the well. If the operator hears water entering the well after drilling this perforation, he knows he has reached a depth beneath the water table, and he again perforates the well casing at approximately this depth a sufficient number of times.

In many applications, where the well casing is perforated at other than great depths under water, the needle valve 126 may either be omitted or left open since the air passed through the valve 122 from the regulator 120 and compressor 110 will be more than enough to inflate the bladder 82 and yet compensate for any air leakage at the vacuum source 128. In such applications, air is evacuated from the hose 124 and the bladder 82 by simply closing needle valve 122 and energizing the vacuum source 128.

It can be seen from the foregoing description that the drilling mechanism 10 is relatively simple in structure and can be easily moved between well locations. It can also be seen that the retraction of the drill bit 52 after each perforation is accomplished by the springs 88, and thus there is little chance of mechanical failure resulting in the drill bit being lodged in the well casing. Since the drill 44 and the bladder 82 are operated entirely by air, the large electrical currents normally associated with drills and similar electrical equipment are not present within the casing and thus do not present a risk of fire or similar hazards if the apparatus is used in an oil or gas well.

Although the presently preferred embodiments of this invention have been described, it will be understood that various changes may be made within the scope of the appended claims.

Having thus described my invention, I claim:

1. In an apparatus for perforating a well casing:

a frame supported for lowering into the well casing; a drilling tool supported on said frame, said drilling tool comprising an air-operable drill and a drill bit connected to said drill and confronting the portion of the well casing to be perforated;

an inflatable bladder mounted on said frame for advancing the frame in a direction toward the portion of the well casing to be perforated to press the drill bit against the portion of the well casing; and spring means for biasing the frame in a direction away from the portion of the well casing.

2. The apparatus of claim 1 wherein said spring means comprises coiled springs mounted on said frame for engaging said well casing.

3. The apparatus of claim 2 further including switch means mounted on said frame member to be engaged by the well casing upon completion of a perforation and connected to alerting means so that upon completion of the perforation said alerting means is energized by said switch means.

4. The apparatus of claim 3 further including a microphone mounted on said frame and connected to audio transmission means for transmitting to an operator of the apparatus signals from the microphone.

5. In an apparatus for perforating a well casing:

a frame for lowering into the well casing;

an air-operated drill and a drill bit supported by said frame, said drill bit rotated by said drill for making a perforation in the well casing;

an inflatable bladder mounted on said frame for advancing the frame in a direction toward the portion of the well casing to be perforated to press the drill bit against the portion of the well casing;

spring means for engaging said casing and biasing the frame in a direction away from the portion of the well casing to be perforated;

air compressor means for operating said air drill and inflating said bladder; and vacuum means for evacuating air from said bladder.

6. The apparatus of claim 5 further including an inner air hose connecting said air compressor means to said air drill and an outer air hose surrounding said first hose for carrying air exhausted from said air drill and extending from said air drill for at least a portion of the length of said inner hose.

7. A method for perforating a well casing, comprising:

providing an apparatus including a frame, an inflatable bladder mounted on one side of the frame, an air drill mounted on the frame and a drill bit connected thereto and extending from a generally opposite side of the frame, spring means mounted along the generally opposite side of the frame, an air compressor for providing air to said air drill and said bladder, and vacuum means connected to said bladder;

energizing said compressor to operate said air drill and inflate said bladder so that said drill bit drills a perforation into the well casing and said spring means biases said frame away from the well casing; and energizing said vacuum means upon completion of said perforation to deflate said bladder so that said spring means moves said frame away from said casing and said drill bit out of said perforation.

8. The method of claim 7 further comprising the steps of:

providing audio signal transmitting means, including a microphone mounted on said frame;

monitoring the sound within the well casing with said transmitting means after withdrawal of said drill bit from said perforation to determine whether water enters the well casing through said perforation.

* * * * *